United States Patent [19]

Everest, III

[11] 4,349,971

[45] Sep. 21, 1982

[54] FORWARD LEAN ADJUSTER FOR SKI BOOTS

[75] Inventor: David C. Everest, III, Boulder, Colo.

[73] Assignee: Lange International S.A., Fribourg, Switzerland

[21] Appl. No.: 226,010

[22] Filed: Jan. 19, 1981

[30] Foreign Application Priority Data

Oct. 3, 1980 [CH] Switzerland ..... 7388/80

[51] Int. Cl.[3] ..... A43B 5/04

[52] U.S. Cl. ..... 36/121

[58] Field of Search ..... 36/121

[56] References Cited

U.S. PATENT DOCUMENTS

| | | | |
|---|---|---|---|
| 3,405,463 | 10/1968 | Werner | 36/121 |
| 3,521,385 | 7/1970 | Dalebout | 36/120 |
| 3,619,914 | 11/1971 | Hanson et al. | 36/121 |
| 3,885,329 | 5/1975 | French | 36/120 |

FOREIGN PATENT DOCUMENTS

| | | | |
|---|---|---|---|
| 2262453 | 2/1974 | Fed. Rep. of Germany | 36/121 |
| 2732522 | 1/1978 | Fed. Rep. of Germany | 36/121 |

*Primary Examiner*—Patrick D. Lawson

*Attorney, Agent, or Firm*—Brumbaugh, Graves, Donohue & Raymond

[57] ABSTRACT

A forward lean adjuster for ski boots includes a stand adapted to be secured to a ski boot lower and a slide plate adapted to be secured to the boot upper. Operating mechanism coupling the stand to the slide plate includes an adjuster body pivotally mounted on the stand and having an operating knob, an adjuster screw in the body to which the knob is secured, and a trunnion on the screw. A cover acting as a lever is pivoted at one end on the trunnion and at its other end on the stand, and the three pivots are positioned to provide over-center operation. With the adjustment body in its open or off position, the stand and slide plate are relatively movable and the ski boot is free hinging. Rotation of the knob and screw moves the trunnion. The forward lean angle of the boot is then altered when the adjustment body is moved through its over-center position to its closed or on position, securing the boot upper and lower against movement.

18 Claims, 6 Drawing Figures

FORWARD LEAN ADJUSTER FOR SKI BOOTS

The present invention relates to a readily operable lean adjuster for providing a desired forward lean angle for ski boots.

BACKGROUND OF THE INVENTION

Ski boots normally include a lower foot receiving portion and an upper leg receiving portion. Often the upper is pivotally or otherwise attached to the lower with provision for restricted movement since the performance requirements of ski boots dictate such semi-rigidity. With this arrangement, movement of the lower leg transmits pressure through the boot to the ski.

The forward lead angle of the boot, i.e., the angle between the upper and lower, determines the angle of the lower leg relative to the foot. To provide optimum equipment for the skier in varying ski conditions, different forward lean angles are desirable for ski boots, the angle depending upon the skill of the skier and the snow on the slope. For example, an upright angle is comfortable when standing or walking, or when skiing powder snow, but a greater forward angle is necessary for skiing steep terrain or when racing. Moreover, personal preferences dictate forward lean angles. Thus, it is desirable for the angle of the boot upper to be readily adjustable relative to the boot lower.

Some prior ski boots have been designed to permit forward lean angle adjustment. In other words, the angle of the ski boot upper could be adjusted relative to the ski boot lower to suit skier desires in various snow conditions. Several methods have been used to adjust ski boot forward lean. The ski boot itself can be constructed or later modified to provide the desired forward lean angle for the particular individual using the boot, and the boot permanently fixed at that angle using rivets or other means to lock the upper in a position relative to the lower. In this circumstance, the forward lean angle is no longer adjustable.

Another method provides a wedge or similar device for insertion between the boot upper and lower to vary the forward lean of the upper. In addition to the difficulty involved in changing wedges on the mountain, this method also has the disadvantage of requiring that the skier carry wedges if a forward lean angle is to be modified during the skiing day.

Still another forward lean adjustment known in the prior art requires special tools which must be available if the forward lean angle is to be adjusted.

Finally, certain forward lean adjustment devices provide only gross changes of relatively large magnitude, thereby precluding a finely turned forward lean setting between those provided by the adjusting device.

Provisions for forward lean adjustment are shown in U.S. Pat. No. 3,619,914. The mechanism has been found satisfactory in certain instances but fails to provide the advantages of the inventive forward lean adjuster disclosed herein.

U.S. Pat. No. 3,521,385 shows still another adjustable forward lean mechanism requiring a tool for adjustment and lacking the hereinafter set forth advantages of the inventive device.

SUMMARY OF THE INVENTION

The present invention provides a lean adjuster readily operable both on and off the mountain. The adjuster can be set to provide a particular boot forward lean angle, and then closed. When desirable, the device can be opened to permit the boot upper to pivot relative to the boot lower, thereby facilitating walking and standing in lift lines. In other words, the adjuster can be "on" or locked to provide a particular forward lean angle, and it can be "off" or open so that the boot is free hinging. Through simple adjustment with the adjuster open, the forward lean angle of the boot may be reset, and the lean adjuster then closed to provide the desired new angle of forward lean.

The lean adjuster generally includes a stand adapted to be secured to a ski boot lower and a slide plate adapted to be secured to the boot upper. Operating mechanism coupling the stand to the slide plate includes an adjuster body pivotally mounted on the stand and having an operating knob, an adjuster screw in the body to which the knob is secured, and a trunnion on the screw. A cover acting as a lever is pivoted at one end on the trunnion and at its outer end on the stand, and the three pivots are positioned to provide over-center operation. Thus with the adjusting body in its open or off position, the stand and slide plate are relatively movable, hence the ski boot upper moves relative to the lower, i.e., the boot is free hinging, permitting comfortable standing and walking by the skier. Moreover, rotation of the knob and screw by the skier moves the trunnion when it is desirable to alter the forward lean angle of the boot. When the adjuster body is then moved through its over-center position to its closed or on position, the boot upper and lower are secured against movement at the desired forward lean angle.

The invention will be better understood when the following description is read in conjunction with the accompanying drawings.

DETAILED DESCRIPTION OF THE PREFERRED EMBODIMENT

Figure 1:
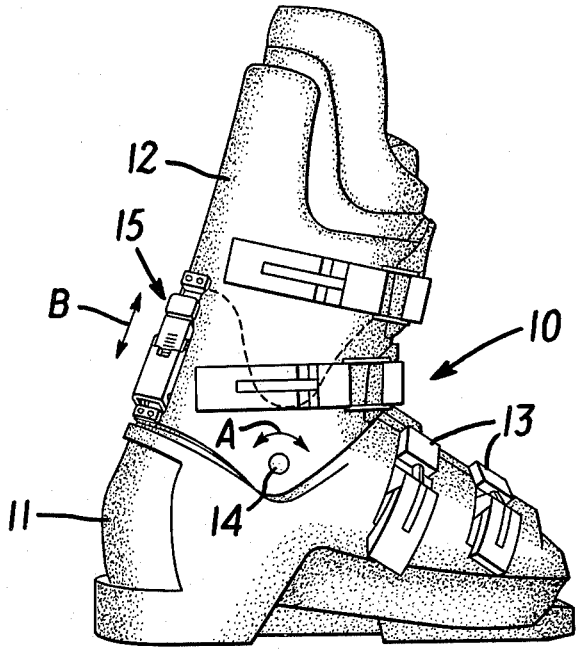
FIG. 1 illustrates a ski boot incorporating the inventive ski boot forward lean adjuster.
Figure 2:
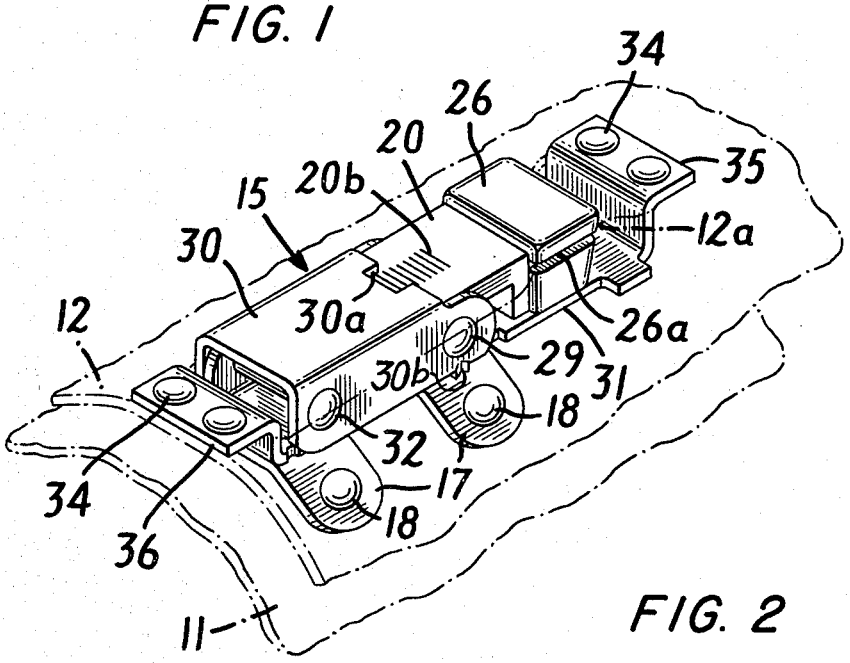
FIG. 2 is a perspective view of the forward lean adjuster.
Figure 3:
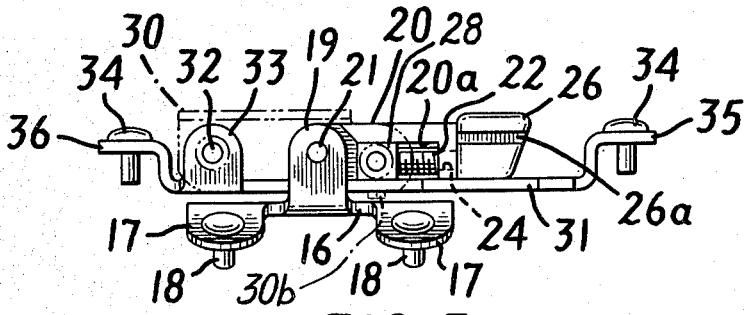
FIG. 3 is an elevation of the forward lean adjuster with a cover shown in dashed outline for clarity.
Figure 4:
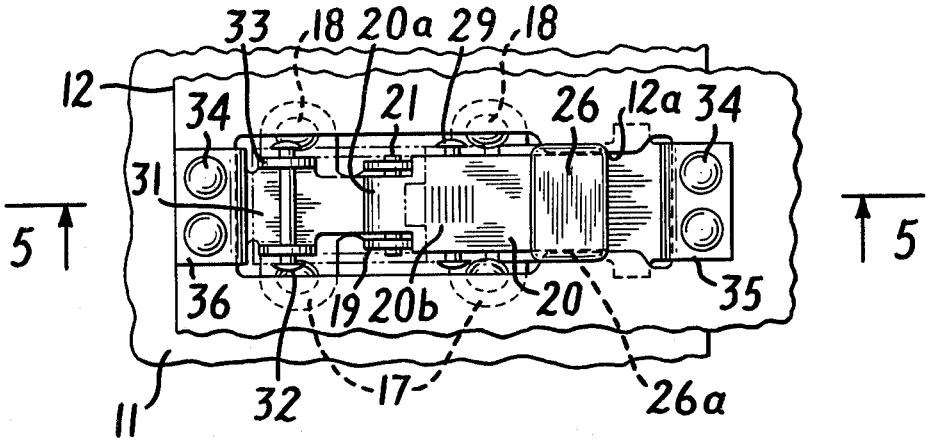
FIG. 4 is a plan view of the adjustable forward lean angle apparatus with the cover shown in dashed outline for clarity.

Referring to the invention in greater deail with particular reference to FIG. 1, a ski boot 10, normally formed of a suitable plastic, includes a boot lower 11, a boot upper or cuff 12 and closure buckles 13. Rivets 14 on each side of the boot pivot the upper 12 on the lower 11 to afford fore and aft movement of the cuff 12, thereby varying the forward lean angle of the boot.

A lean adjuster 15 for varying the forward lean angle of the upper 12 with respect to the lower 11, shown in its on position, i.e., closed or locked, is secured to the lower 11 and upper 12 of the boot 10. Operating the adjuster 15 to its off or open position permits the upper 12 to hinge freely on the lower 11. When open, adjustment of the device 15 causes the boot upper 12 to be moved or rotated on the rivets 14, when the adjuster is closed, as indicated by arrows A and B. Such movement can provide different forward lean angle characteristics for the boot 10. With the adjuster 15 in its off or unlocked position (see FIG. 6), the boot upper 12 is movable with respect to the lower 11, i.e., is free hinging, thereby facilitating standing or walking by the skier.

Referring to the lean adjuster 15 in greater detail with particular reference to FIGS. 2 through 6, a stand 16 is secured by four flanges 17 and rivets 18 to the boot lower 11. A pair of laterally spaced upstanding arms 19 provide a pivot point for a lean adjuster body 20 via a pivot pin 21 passing through the arms 19 and an end 20*a* of the body 20.

An adjuster screw 22 is rotatably mounted in a counterbored opening 23 at one end and an opening 24 in the other end of the body 20. A flange 25 on one end of the screw 22 fits the counterbored opening and cooperates with a knob 26, formed with grooves 26*a* and press fitted over ridges 27 on the other end of the screw 22, to retain the screw in the body. The knob could also be pinned on the screw.

A trunnion 28 on the screw 22, and located in a recess 20*a* in the body 20, is fastened by suitable pins 29, extending into opposed bores on each side of the trunnion, to one end of a U-shaped lever or cover 30. The pins 29 can be secured to the cover 30 by suitable means, for example welding. At its other end the cover 30 is secured to a slide plate 31, juxtaposed with the stand 16 and sliding between spaced arms 19, by a pin 32 extending through openings in a pair of upstanding slide plate flanges 33.

Figure 5:
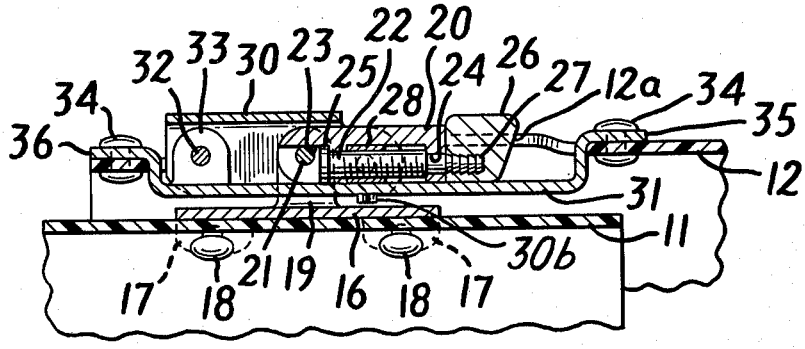
FIG. 5 is a cross-sectional view of the adjuster shown in FIG. 4 taken along the view line 5—5 looking in the direction of the arrows.

The pivots provided by the pins 21, 29 and 32 are positioned to provide over-center action when the body 20 is pressed toward its closed position, as shown in FIG. 5, thereby effectively locking it closed in the "on" position. In addition, tabs 30*b* extending downwardly and slightly inwardly on each side of the cover 30, clip under the slide plate 31 to hold the adjuster closed. If desired, tabs 12*a* can be provided on the boot upper to fit grooves 26*a* to assist in securing the adjuster in its closed or locked position.

Figure 6:
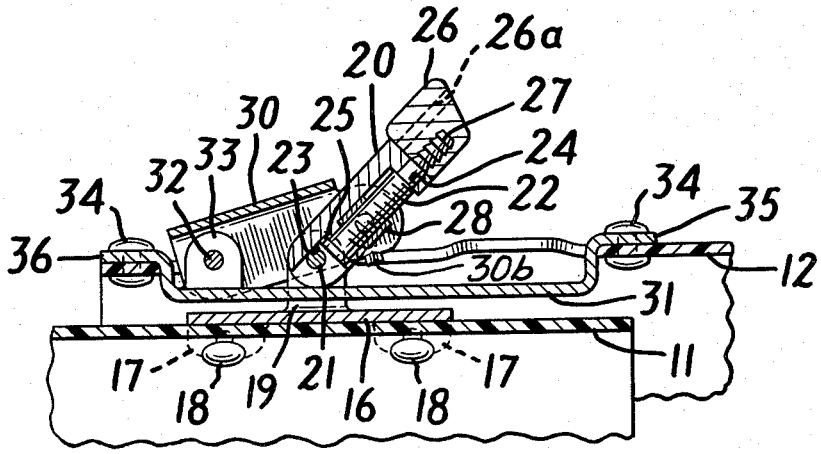
FIG. 6 is a view similar to FIG. 5 with the forward lean adjuster in its open or released position.

As shown in FIGS. 5 and 6, the slide plate 31 is secured in a suitably sized opening in the boot upper 12 by rivets 34 passing through flanges 35 and 36 at the ends of the slide plate 31. The slide plate 31 may also be secured in or mounted on the upper 12 by force-fitting it into the opening in the boot upper, and the rivets omitted.

To use the lean adjuster 15, the knob 26 is grasped and pulled from its closed or on position to its open or off position. With the knob 26 pulled outwardly, as shown in FIG. 6, the slide plate 31 is movable relative to the stand 16, hence the boot upper 12 can pivot about rivets 14 on the boot lower 11 and there is movement as shown by the arrows A and B. Under these conditions, the boot is free hinging and a skier can stand upright comfortably while waiting for a ski lift or can walk comfortably. Upon reaching the top of the mountain, the knob 26 is merely pressed forwardly to its locked or on position which causes the slide plate 31 to assume its previous position relative to the stand 16. With the abovedescribed over-center action, as best shown in FIGS. 5 and 6, the lean adjuster 15 is locked into its closed position. The tabs 12*a* in the grooves 26*a* assist in retaining the adjuster closed.

The forward lean adjustment shown in the drawings is minimal. If a greater forward lean angle is desired for the ski boot, the knob 26 is pulled to its open position and then rotated counterclockwise. This causes the trunnion to move along the screw 22. When the knob is then pushed to its closed position, the slide plate 31 is shifted to the right relative to the stand, again referring to FIGS. 5 and 6, and the boot upper 12 is rotated forwardly on the boot lower 11, thereby providing a greater forward lean angle for the boot and skier. Indicia 20*b* on the body 20 cooperate with a cut away portion 30*a* in the cover to enable both boots of a pair to be adjusted to the same forward lean angle.

It will be understood that the above described embodiment is merely exemplary and that persons skilled in the art may make variations and modifications without departing from the spirit and scope of the invention. All such modifications and variations are intended to be within the scope of the invention as defined in the appended claims.

I claim:

1. A ski boot forward lean angle adjuster comprising a stand adapted to be secured to a boot lower, a slide plate adapted to be secured to a boot upper, operating means pivotally mounted on the stand and the slide plate and coupling them together, said operating means being movable between (1) an open or off position permitting relative movement between the stand and the slide plate and providing a free hinging ski boot, and (2) a closed or on position locking the stand and the slide plate against relative movement and providing a boot with a selected forward lean angle.

2. A lean adjuster as defined in claim 1, wherein the operating means includes an adjustment apparatus which is adjustable when the operating means is in its off position, the adjustment apparatus being adjustable to provide a selected relative position between the stand and the slide plate when the operating means is in its on position.

3. A lean adjuster as defined in claim 2, wherein the adjustment apparatus includes a screw operated by a knob.

4. A ski boot forward lean angle adjuster comprising a stand adapted to be secured to a boot lower, a slide plate adapted to be secured to a boot upper, operating means pivotally mounted on the stand and the slide plate for coupling them together, said operating means including body means pivoted on the stand, a lever pivoted at one end on the slide plate and at the other end on the body means, the body means being movable between an open or off position permitting relative movement between the stand and the slide plate and a closed or on position locking the stand and slide plate against relative movement.

5. A lean adjuster as defined in claim 4, wherein the body means includes a screw, a trunnion carried by the screw, and the other end of the lever is pivoted on the trunnion, a knob on the screw rotatable when the body means is in its open position to move the trunnion and provide a selected relative position between the stand and the slide plate when the body means is in its closed position.

6. A lean adjuster as defined in claim 5, wherein the lever comprises a cover for the adjuster.

7. A lean adjuster as defined in claim 6, in which indicia is provided on the body means for cooperation with the cover to indicate the forward lean angle of the ski boot.

8. A ski boot forward lean angle adjuster comprising a stand adapted to be secured to a boot lower, a slide plate adapted to be secured to a boot upper, a body pivotally mounted on the stand, a screw rotatably carried by the body, an operating knob secured to the screw for rotating it, a trunnion carried by the screw, a lever pivoted at one end on the trunnion and at the other end on the slide plate, the body being rotatable between an open or off position and a closed or on position, the body when rotated to the closed position locking the stand and slide plate in a selected relative position according to a desired boot forward lean angle, the selected relative position being determined by the location of the trunnion along the screw, the body when in its open position permitting relative movement between the stand and the slide plate and providing a free hinging ski boot, the body when in its open position enabling rotation of the knob to move the trunnion to a selected position on the screw.

9. A lean adjuster as defined in claim 8, wherein the three pivots are positioned to provide over-center operation of the body as it is rotated into its closed or on position.

10. A lean adjuster as defined in claim 8 or 9, wherein the knob is formed with a recess adapted to cooperate with a tab on the ski boot upper to hold the body in its closed position.

11. A lean adjuster as defined in claim 8, wherein the lever comprises a cover for the adjuster.

12. A lean adjuster as defined in claim 11, wherein tabs are provided on the cover for cooperating with the slide plate to hold the body in its closed position.

13. A lean adjuster as defined in claim 11, in which indicia is provided on the body for cooperation with the cover to indicate the forward lean angle of the boot.

14. A ski boot forward lean angle adjuster comprising a stand adapted to be secured to a boot lower, a slide plate adapted to be secured to a boot upper, a body pivotally mounted on the stand, a screw rotatably carried by the body, an operating knob secured to the screw for rotating it, a trunnion carried by the screw, a lever pivoted at one end on the trunnion and at its other end on the end of the slide plate, the pivot on the stand being located between the trunnion pivot and the slide plate pivot, the body being rotatable between an open or off position and a closed or on position, the three pivots being positioned to provide over-center operation of the body as it is rotated into its closed position, the body when rotated to the closed position locking the stand and slide plate in a selected relative position according to a desired boot forward lean angle, the selected relative position being determined by the location of the trunnion along the screw, the body when in its open position permitting relative movement between the stand and the slide plate and providing a free hinging ski boot, the body when in the open position enabling rotation of the knob to move the trunnion to a selected position on the screw.

15. A lean adjuster as defined in claim 14, wherein the lever comprises a cover for the adjuster.

16. A lean adjuster as defined in claim 15, in which indicia is provided on the body for cooperation with the cover to indicate the forward lean angle of the boot.

17. A lean adjuster as defined in claim 14, wherein the knob is formed with a pair of recesses on its opposite sides adapted to cooperate with tabs on the ski boot upper to hold the body in its closed position.

18. A lean adjuster as defined in claim 15, wherein tabs are provided on the cover for cooperating with the slide plate to hold the body in its closed position.

* * * * *